US010195503B1

(12) United States Patent
Lesh

(10) Patent No.: US 10,195,503 B1
(45) Date of Patent: Feb. 5, 2019

(54) DISK THROWING DEVICE

(71) Applicant: David Lesh, Denver, CO (US)

(72) Inventor: David Lesh, Denver, CO (US)

( * ) Notice: Subject to any disclaimer, the term of this patent is extended or adjusted under 35 U.S.C. 154(b) by 0 days.

(21) Appl. No.: 15/956,646

(22) Filed: Apr. 18, 2018

Related U.S. Application Data

(60) Provisional application No. 62/486,621, filed on Apr. 18, 2017.

(51) Int. Cl.
*F41J 9/18* (2006.01)
*F41B 3/00* (2006.01)
*A63B 59/30* (2015.01)

(52) U.S. Cl.
CPC ..... *A63B 59/30* (2015.10); *F41B 3/00* (2013.01); *F41J 9/18* (2013.01)

(58) Field of Classification Search
CPC ..... F41B 3/00; F41J 9/18
See application file for complete search history.

(56) References Cited

U.S. PATENT DOCUMENTS

| | | | | |
|---|---|---|---|---|
| 1,175,035 | A | 3/1916 | Wooster | |
| 1,585,446 | A * | 5/1926 | Warwick | A63B 59/20 124/5 |
| 2,124,738 | A | 7/1938 | Johnsen | |
| 2,493,245 | A | 1/1950 | Hansen | |
| 3,537,438 | A | 11/1970 | Reed | |
| 3,901,208 | A | 8/1975 | Laporte et al. | |
| 4,076,004 | A * | 2/1978 | Huelskamp | F41J 9/28 124/43 |
| 4,222,361 | A | 9/1980 | Jackson et al. | |
| 4,233,952 | A * | 11/1980 | Perkins | F41B 3/00 124/42 |
| 4,549,521 | A | 10/1985 | Hargrave, Jr. | |
| 4,974,574 | A * | 12/1990 | Cutlip | F41B 3/00 124/43 |
| 7,665,454 | B1 | 2/2010 | D'Agostino | |
| 7,900,617 | B1 | 3/2011 | Kersh | |
| 8,511,292 | B2 | 8/2013 | Black et al. | |
| 2005/0070198 | A1 | 3/2005 | Pickering et al. | |
| 2008/0004140 | A1 | 1/2008 | Matsumoto et al. | |
| 2008/0261732 | A1 | 10/2008 | Mullin | |
| 2014/0144417 | A1 | 5/2014 | Evans | |

* cited by examiner

*Primary Examiner* — John Ricci
(74) *Attorney, Agent, or Firm* — Jason P. Webb; Pearson Butler

(57) ABSTRACT

A disk throwing device, comprising a handle and a fork. The fork is coupled to the handle and extending therefrom along a first axis. The fork having a pair of prongs extending therefrom from an end thereof opposite the handle. The pair of prongs meeting at a prong junction and having a common top surface substantially orthogonal to the first axis such that a disk may slide freely across the top surface. The disk throwing device also comprises a clip, extending orthogonally away from the fork in relation to the first axis at a first portion at the prong junction. The clip having a second portion coupled to the first portion that extends substantially parallel to the first axis such that it may trap a disk between the clip and the pair of prongs.

20 Claims, 8 Drawing Sheets

DISK THROWING DEVICE

CROSS-REFERENCE TO RELATED APPLICATIONS

This invention claims priority, under 35 U.S.C, § 120, to the U.S. Provisional Patent Application No. 62/486,621 by Lesh filed on 18 Apr. 2017, which is incorporated by reference herein in its entirety.

BACKGROUND OF THE INVENTION

Field of the Invention

The present invention relates to a device or apparatus for launching an object, specifically a disk throwing device, such us disk throwing devices used in conjunction with play/exercise for animals.

Description of the Related Art

In the related art, it has been known to use objects to play fetch with animals. Many animals, especially canines, enjoy fetching objects, such as sticks, balls or plastic disks. Pet owners commonly throw an object some distance for a pet, to retrieve and return to the owner. Such activity not only provides exercise for the pet, but also strengthens the bond between pet and owner.

When an object is picked up in an animal's jaws, a portion of the object is often coated with saliva from the animal's mouth. People typically find touching or picking up an object covered with animal saliva unpleasant. Thus, once the object is so coated, a pet owner generally has a disincentive to continue playing with his or her animal.

Additionally, some animals may become possessive and snap at a person's hand when he or she attempts to retrieve that ball. Moreover, if a person has back, joint, or other pain or stiffness, it may be difficult or painful for him or her to bend over to pick up a retrieved object when an animal drops it. Also, some individuals can throw objects further through the use of throwing devices, thereby providing a pet with a greater challenge.

Accordingly, object throwing devices have been developed to facilitate in such play and/or exercise with animals, for use with various objects to be thrown, such as disks and balls. Such throwing devices may elongate the reach of the thrower and/or may allow the thrower to launch the object without touching the same.

Some improvements have been made in the field. Examples of references related to the present invention are described below in their own words, and the supporting teachings of each reference are incorporated by reference herein:

U.S. Patent Application Publication No.: US 2008/0004140, by Matsumoto et al., discloses an apparatus for throwing and picking up a sphere. A user may employ the apparatus, for example, to throw a sphere. The user may also employ the apparatus to pick up the sphere without requiring any portion of the user to come into contact with the sphere. The apparatus may include a claw or gripper for holding the sphere. The claw may have three or more prongs for gripping the sphere and may be attached to a handle. The handle may telescope from a retracted position to an operating position. The handle may include gripping surfaces to aid a user in holding the handle, and a clip for attaching the throwing apparatus to a belt, a hanger or other suitable support.

U.S. Pat. No. 2,124,738, issued to Johnsen, discloses a target holder comprising an elongated handle, and a stiff but elastic wire secured at one end only to said handle and extending in alignment with said handle to form a shank of not less than half the length of said handle. Said wire beyond said shank being turned laterally and forwardly, and finally laterally and upwardly, to form vertical and lateral supports for a target, U.S. Pat. No. 7,900,617, issued to Kersh, discloses an apparatus for launching a flying disc comprises launching and handle members connected to permit relative angular motion, a disc gripper connected to the launching member, and a release mechanism coupled to the disc gripper to (i) enable it to hold the disc with the launching and handle members forming an angle less than a release angle and (ii) cause the disc gripper to release automatically the held disc as the launching and handle members move to the release angle. Launching the disc comprises: arranging the launching and handle members to form an angle less than the release angle; loading the disc into the disc gripper; engaging the release mechanism to engage the disc gripper to hold the disc; and grasping the handle member and swinging the launching apparatus to cause the launching and handle members to move to the release angle and to cause automatically the disc gripper to release the disc, thereby launching the disc.

U.S. Patent Application Publication No.: US 2005/0070198, by Pickering et al., discloses a flying disk accessory with a C shaped member and an attached handle member. The handle member has a gripping portion attached to an elongated rod shape. The end of the rod portion of the handle member is joined to the C shaped member at the lower portion of the C shape. The C shape has a U shaped cross section where the legs of the U shape are facing toward the center of the C shape. The C shape has a spring biased hinged joint near the junction of the C shape so that the rod portion is fixedly joined to the lower portion of the C shape. The C shape ends each curve outwardly in the opposite direction of the curve of the main body of the C shape. A hinge pin midway along the handle rod allows for folding during storage.

U.S. Pat. No. 8,511,292, issued to Black et al., discloses a clay target throwing device comprising two unique main components, that, both separately and upon combination, provide for a significantly improved hand-held clay target thrower device. The first main component is a unitary rear-loading flexible wire headend. The second main component is a specially formed handle including a self-cocking block component and an impact backstop structure. Together combined flexible wire headend and handle provide an easy-to-use, efficient, comfortable, and weather-resistant hand-held self-cocking and controlled release clay target throwing unit.

U.S. Pat. No. 3,901,208, issued to Laporte et al., discloses a device for use in target shooting for assisting the manual throwing of clay pigeons. The throwing apparatus comprises a resilient arm defining, at one end, a retaining stop and a target supporting notch extending inwardly from the stop toward a handle. The apparatus also has a support member which extends outwardly from the arm to terminate in a target receiving channel spatially displaced from the notch in the arm. The target receiving channel may be adjusted longitudinally of the resilient arm.

The inventions heretofore known suffer from a number of disadvantages which include: not being able to be used with soft frisbees; requiring the use of magnets, electronics, actuating members, and/or moving parts; being harmful to a dog's teeth and/or gums; not working with many types, sizes, and/or styles of frisbees; not allowing a frisbee to be thrown at a greater distance and/or speed; being difficult for a novice to use to throw a frisbee; not providing a consistent grip for throwing a frisbee; not protecting the user from dog slobber; not allowing for both right-handed and left-handed throwing; and not allowing the user to throw frisbees.

What is needed is a disk throwing device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available disk throwing devices. Accordingly, the present invention has been developed to provide a disk throwing device.

In one, non-limiting embodiment, there may be a disk throwing device which may include a handle; a fork, which may be coupled to the handle and/or extending therefrom along a first axis, the fork may have a pair of prongs extending therefrom from an end thereof opposite the handle, the pair of prongs may meet at a prong junction and/or may have a common top surface substantially orthogonal to the first axis such that a disk may slide freely across the top surface; and/or a clip, which may extend orthogonally away, from the fork in relation to the first axis at a first portion at the prong junction and/or the clip may have a second portion which may be coupled to the first portion that may extend substantially parallel to the first axis such that it may trap a disk between the clip and/or the pair of prongs.

Another non-limiting embodiment may include a rigid webbing, which may be coupled to the pair of prongs and/or disposed therebetween. In yet another non-limiting embodiment, there may be an adjustment mechanism which may be functionally coupled to the prongs, such that a distance between the pair of prongs may be adjustable. Further, in another non-limiting embodiment, the prongs may be tapered such that a diameter of a distal prong end may be less than a diameter of a proximate prong end.

Also, in a non-limiting embodiment, the pair of prongs together may form a section of an ellipse. In addition, in one non-limiting embodiment, each prong may include an array of ridges, which may be disposed along a front edge of a distal prong end. Too, in a non-limiting embodiment, each prong may include a flat bottom surface and/or a flat top surface and/or the flat bottom surface may be parallel to the flat top surface.

Moreover, in another non-limiting embodiment, each prong may include a plurality of spiked grooves, which may be coupled to an outside edge of a distal prong end, and/or extending outwardly therefrom. Additionally, in one non-limiting embodiment, the fork may include a weighted portion, which may be disposed along a length of the fork. Furthermore, in a non-limiting embodiment, the handle may include a first handle indent which may be disposed along a top handle side; and/or a second handle indent, which may be disposed along a bottom handle side, opposite the top handle side.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, hut do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention become more fully apparent from the following description and appended claims or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
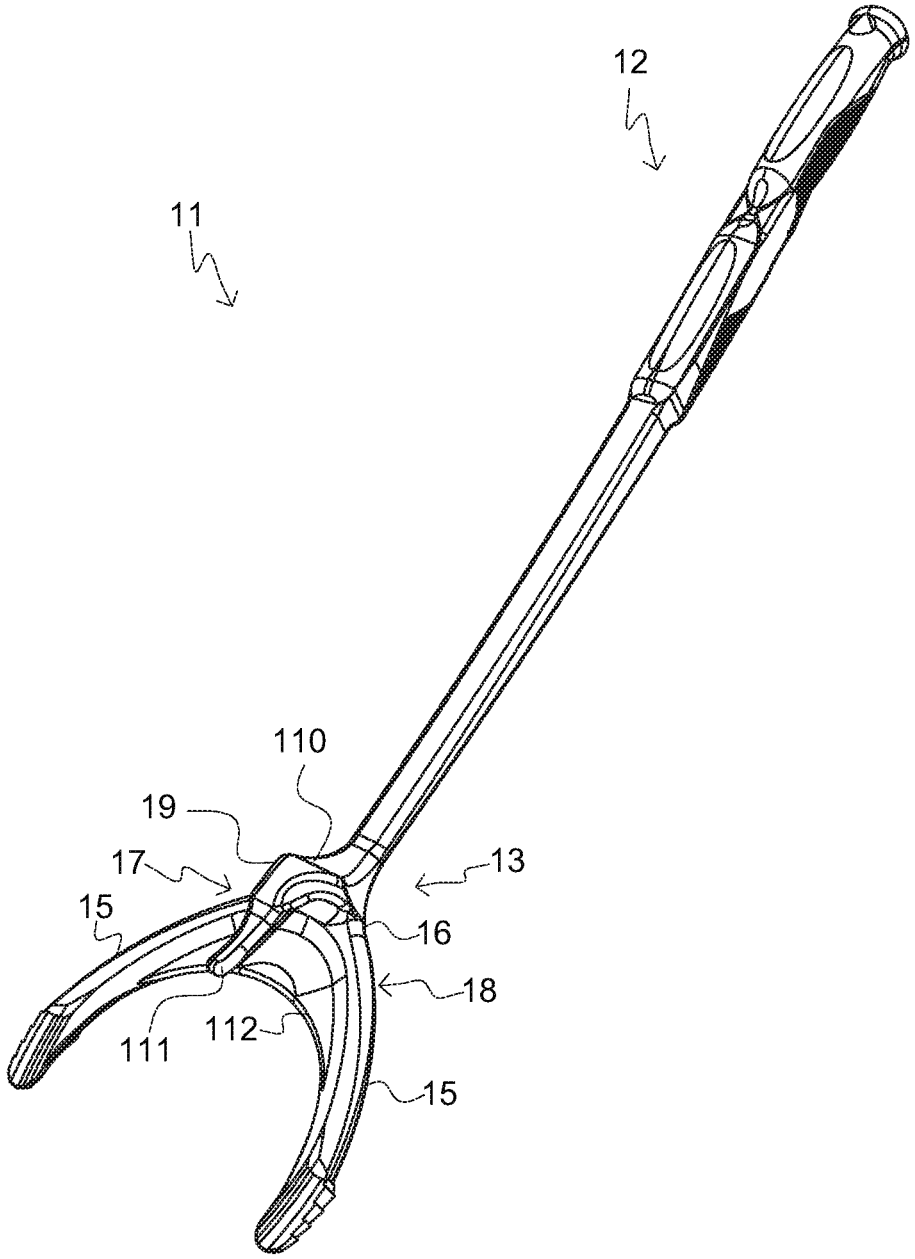
FIG. 1 is a top perspective view of a disk throwing device, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodimentis identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Looking to FIGS. 1-7, there is shown a disk throwing device 11, according to one embodiment of the invention. There is shown a disk throwing device 11 with a handle 12, a shaft, and a fork 13 coupled to the handle 12 via the shaft 170. As shown, the fork 13 extends from the handle 12 along a first axis 14 and the fork 13 has a pair of prongs 15 that extend forward from the shaft 170. The illustrated prongs 15 extend from the fork 13 at an end opposite the handle 12. The illustrated prongs 15 meet at a prong junction 17 and have a common top surface 18 substantially orthogonal to the first axis 14 such that a disk, or frisbee, may slide freely across the top surface 18.

One skilled in the art would understand that the various components may be manufactured using a variety of manufacturing techniques, including but not limited to injection molding, extrusion molding, blow molding, rotational molding, casting, machining, joining, forging shearing, stamping, rolling, pressing, milling, 3D printing, and the like and combinations thereof and that the various components may be assembled together and connected by one or more of various techniques such as but not limited to using welding, adhesives, fasteners, and the like and combinations thereof.

Figure 2:
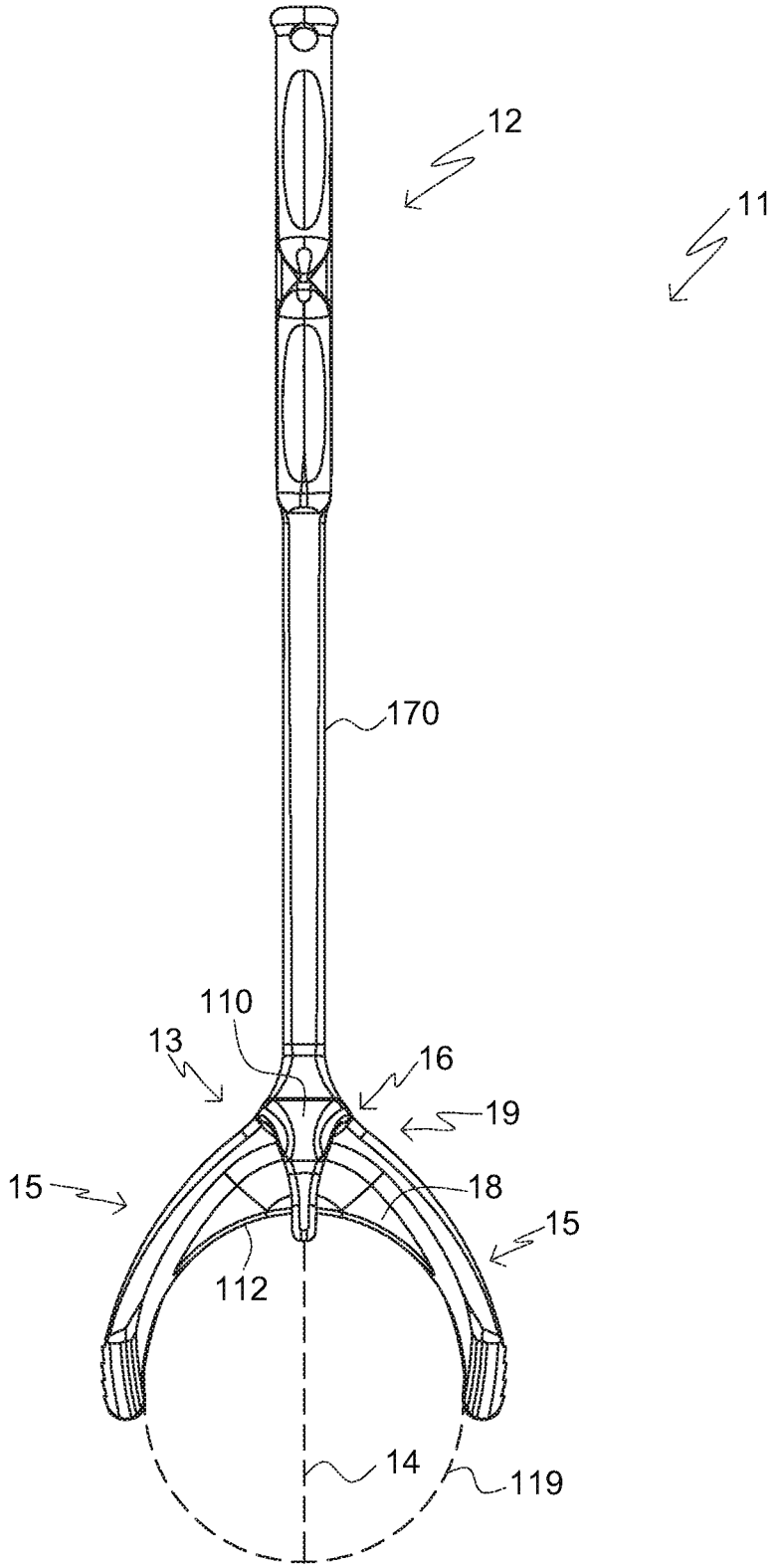
FIG. 2 is a top elevational view of a disk throwing device, according to one embodiment of the invention.

The illustrated prongs 15 together form a section of an ellipse 119 (See FIG. 2). As shown, the prongs 15 are symmetrical. Advantageously, having prongs 15, which are symmetrical allows both right-handed and left-handed persons to use the device 11 as either prong 15 can push the disk While the other prong 15 stabilizes it.

The disk throwing device of FIGS. 1-7 also includes a clip 19. The illustrated clip 19 has a first portion 110 that extends orthogonally 140 away from the fork 13 in relation to the first axis 14 at the junction 17. As illustrated, the clip 19 also has a second portion 111 coupled to the first portion 110. As shown, the second portion 111 extends substantially parallel 142 to the first axis 14 with a bend therein 143 forming a narrow neck in the slot between the clip 19 and the prongs 15, so that the disk throwing device 11 can trap a disk, or frisbee, between the clip 19 and the pair of prongs 15.

In operation, the fork 13 makes contact with a disk in three places: with each of the prongs 15 and clip 19. One prong 15 pushes on the inside lip of a disk, while the other prong 15 keeps the disk flat, stabilized, and relatively parallel to the ground. The clip 19 keeps the disk from falling out. It is envisioned that the outer surfaces of the prongs 15 may be coated in a substance, such as rubber, to help grip the lip of a disk. The illustrated prongs 15 are also tapered to aid in the device 11 slipping under a disk to pick it up off the ground.

The illustrated prongs 15 also include a plurality of spiked grooves 124 coupled to an outside edge 125 of a distal prong end 116 and extending outwardly therefrom. The spiked grooves 124 are also contoured to match the inner lip of a disk. One skilled in the art would understand that the spiked grooves 12.4 may, collectively, be serration, so that the edge 125 is jagged or saw-like.

Further shown by FIGS. 1-7, each prong 15 includes a flat bottom surface 122 and a flat top surface 123. As illustrated, the flat bottom surface 122 is substantially parallel to the flat top surface 123 such that prongs extend in generally the same line as the handle and shaft (See FIG. 3). Flat prongs 15 are advantageous when operating the device 11. Because the upper surface on which the disk rests is flat, the lip of the disk doesn't get obstructed by anything as it exits the device 11.

Further, illustrated by FIGS. 1-7, the disk throwing device 11 includes a rigid webbing 112. The illustrated rigid webbing 112 is coupled to the prongs 15 and disposed therebetween, forming a support structure shaped similar to the webbing between the thumb and forefinger on the human hand.

Figure 3:
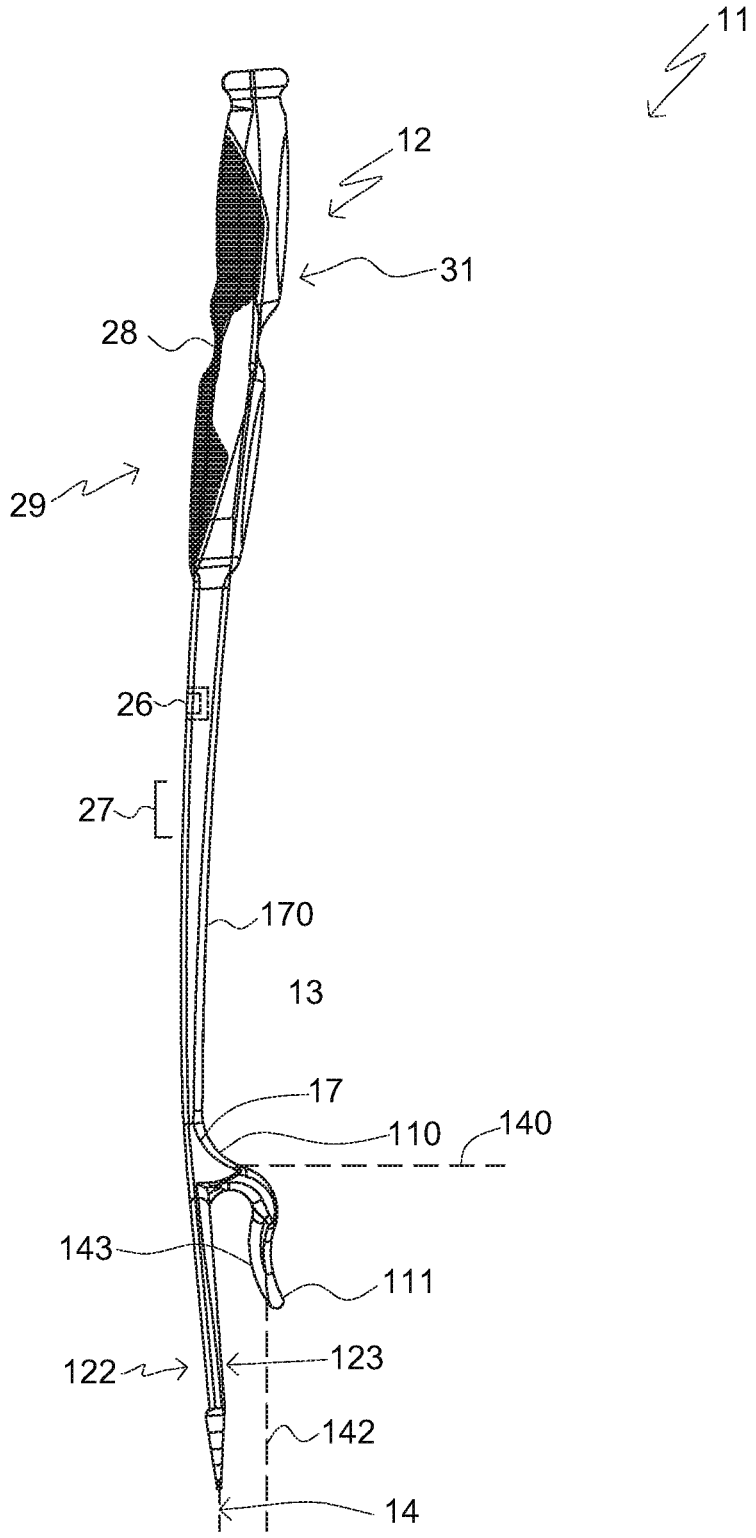
FIG. 3 is a side elevational view of a disk throwing device, according to one embodiment of the invention.
Figure 4:
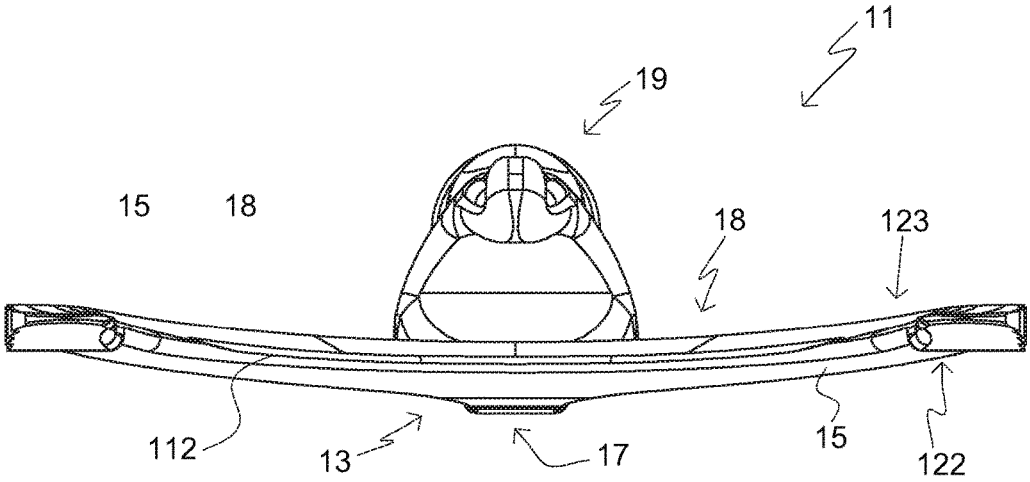
FIG. 4 is a front plan view of a disk throwing device, according to one embodiment of the invention.
Figure 5:
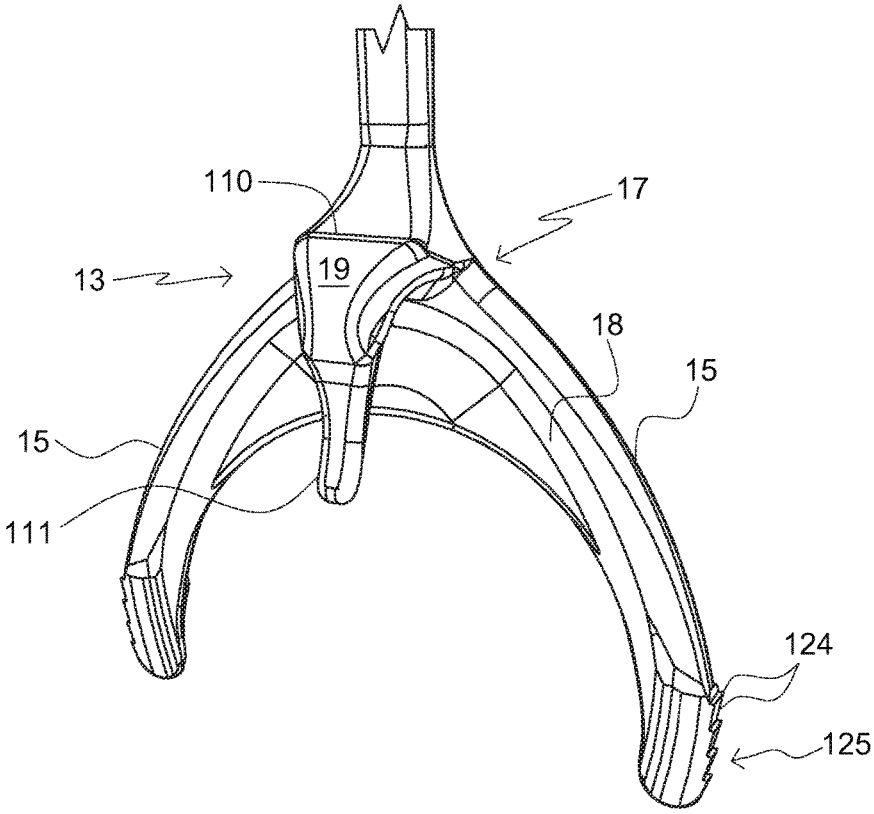
FIG. 5 is a partial perspective view of a fork of a disk throwing device, according to one embodiment of the inventi
Figure 6:
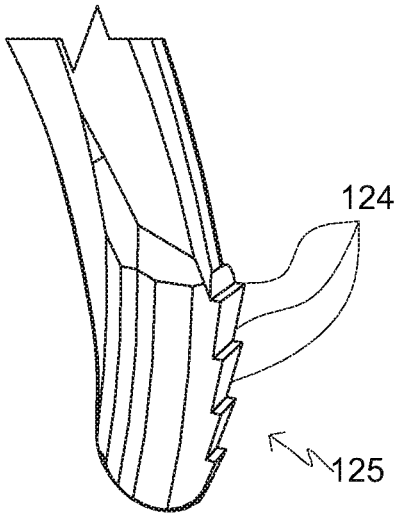
FIG. 6 is a partial perspective view of a prong of a disk throwing device, according to one embodiment of the invention.
Figure 7:
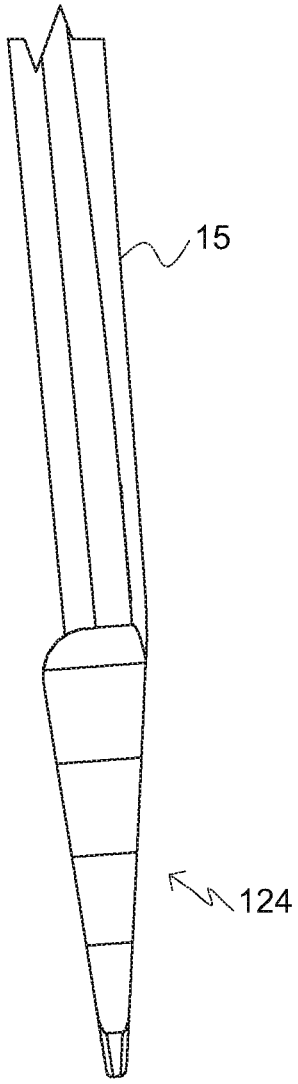
FIG. 7 is a partial side elevational view of a prong of a disk throwing device, according to one embodiment of the invention.

Looking specifically to FIG. 3, there is a shaft 170 with a weighted portion 26 disposed along a length 27 of the fork 13. One skilled in the art would understand that a weight 26 may be removably attached to the fork 13. For instance, the weighted portions may be a weight such as a lab weight of set such as the Learning Resources Brass Mass Set, by Learning Resources, available at https://goo.gl/V2H9ih, which is incorporated by reference herein. Moreover, one skilled in the art would also understand that a weight may be incorporated into the fork 13 during manufacture of the device. For example, the weighted portion 26 of the fork 13 may include a dense material, such as, but not limited to metals such as hut not limited to: lead, iron, brass and/or steel.

The illustrated handle 12 has a first handle indent 28 disposed along a top handle side 29, and a second handle indent 30 disposed along a bottom handle side 31. As shown, the first handle indent 28 is disposed opposite the second handle indent 30. Accordingly, the handle 12 is curved to match a user's hand. The indents 28, 30 help a user securely grip the device.

In one non-limiting embodiment of the invention, the device has a density less than that of water so that it floats on water, such that if a user accidentally launches the device itself over a body of water, it will float and not sink.

Advantageously, the illustrated device provides for an easy to use tool to launch disks while playing with an animal (e.g. dog) that makes it easy to pick up the disk and launch it without directly touching the disk. Another advantage is that, in snapping a sift frisbee into the device, the frisbee bends, thereby dislodging some or all of any material (e.g. saliva, dirt, mud) that may be on the frisbee, therefore allowing the frisbee to achieve better, longer, and/or more consistent throws.

In operation, a user of a disk throwing device 11 uses the disk throwing device 11 to make contact with a disk, or frisbee. The user secures the disk in the disk throwing device 11 by extending the device 11 and sliding the prongs 15 of the fork 13 under the disk, between the disk and the ground. The clip 19 presses on the disk to secure disk in place. On hard, slippery surfaces (like pavement, short grass, etc.) it may be useful for the user to place their foot on the opposite side of the frisbee to prevent the frisbee from sliding out as it is scooped up with the device 11. The user then releases the disk from the device 11 by exercising a horizontal throwing motion similar to that of throwing a frisbee without the device 11. The user can snap their wrist at the end of the stroke to aid in achieving a good, consistent release of the disk to better aim it and achieve longer flight distances.

Figure 8:
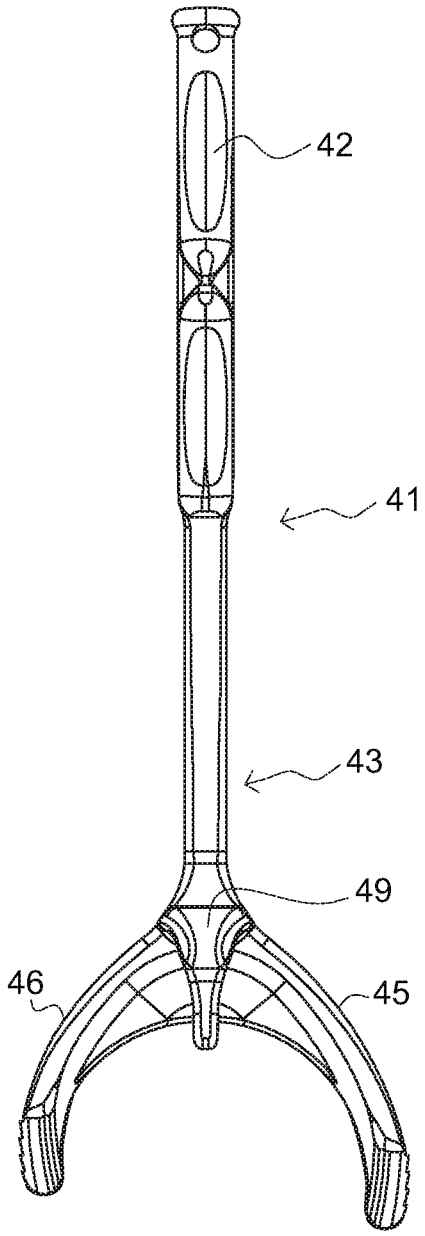
FIG. 8 is a top elevational view of a disk throwing device, according to one embodiment of the invention.

FIG. 8 illustrates a disk throwing device 41, according to one embodiment of the invention. The disk throwing device 41 illustrated by FIG. 8 shows a fork 43 with prongs 45 and 450, the fork coupled to a shaft 41 having a handle 42. As shown, the prongs 45 and 450 shown by FIG. 8 are not symmetrical as they have different sizes. Having prongs 45 and 450 of different length may be desirable to customize the device 41 for right-handed or left-handed users.

Figure 9:
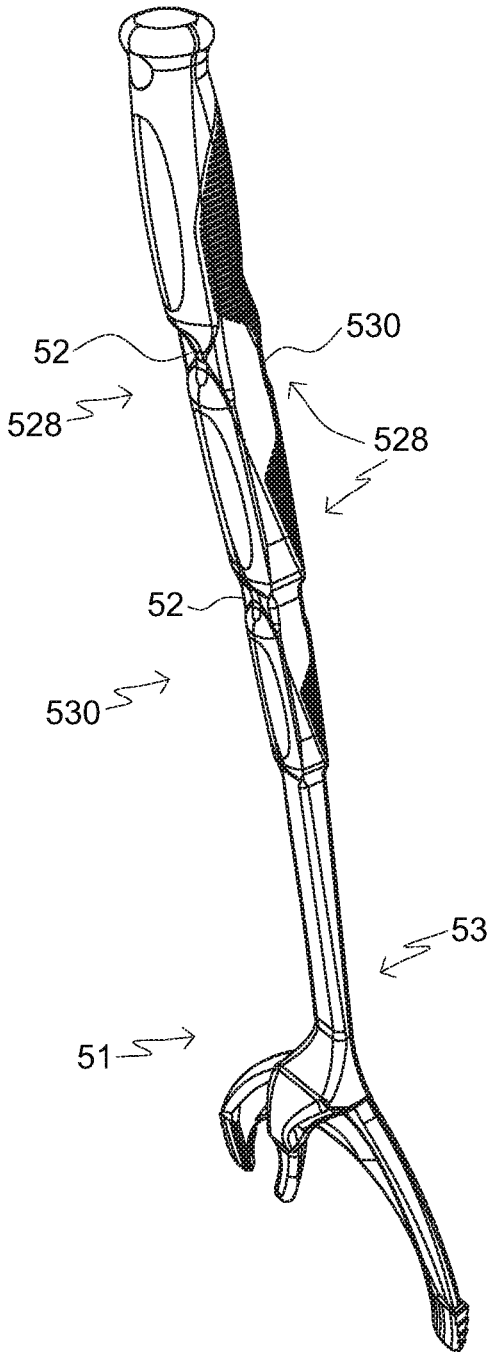
FIG. 9 is a side view of a portion of a handle and shaft of a disk throwing device, according to one embodiment of the invention.

FIG. 9 illustrates a side view of a part of a handle 53 and a part of a shaft 52 of a disk throwing device 51, according to one embodiment of the invention. As shown by FIG. 9, the handle 52 of the disk throwing device 51 has duplicate first and second handle indents 528, 530. As a result, the disk throwing device 51 could be gripped with two hands during operation, thereby helping the user to achieve longer, more accurate throws.

Figure 10:
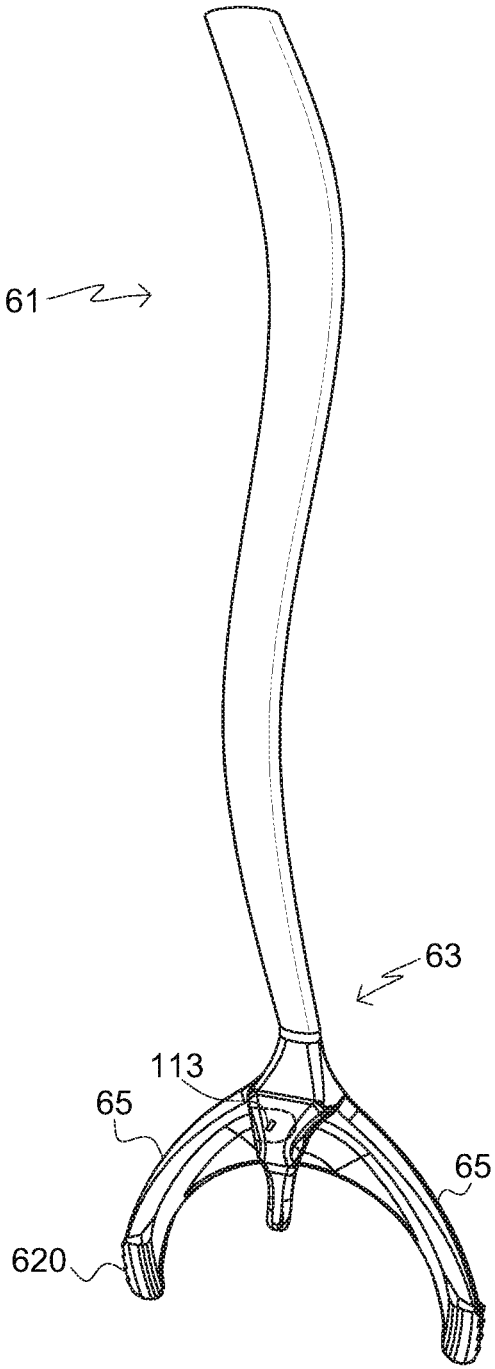
FIG. 10 is a top perspective view of a disk throwing device, according to one embodiment of the invention.

FIG. 10 illustrates a disk throwing device 61, according to one embodiment of the invention. FIG. 10 shows a disk throwing device 61 with a curved shaft 63. A curved shaft 63 may be desirable when throwing a disk tor increasing accuracy and/or distance. The disk throwing device is also shown by FIG. 10 to be lacking additional gripping structure on a handle region 61. One skilled in the art would understand that the device could be manufactured as one continuous object, composed entirely of the same material, such as plastic or rubber.

In addition, FIG. 10 shows an adjustment mechanism 113. As shown, the adjustment mechanism 113 is functionally coupled to the prongs 15. Accordingly, a distance 14 between the pair of prongs 15 is adjustable. For example, a user may want to adjust a distance 14 between the pair of prongs 15 to accommodate disks or objects of various shapes and sizes. In one non-limiting example, a user may adjust the distance between the tips of the prongs and/or the angles of the prongs relative to the shaft. One skilled in the art would understand that the adjustment mechanism could be such as a clamp or a vice similar to the fastening tools of Home Depot, available at https://www.homedepot.com/b/Tools-Hand-Tools-Fastening-Tools-Clamps-Vises/N-5yc1Zc97y, which is incorporated by reference herein. Thus, the device 11 can be adjusted to accommodate frisbees of different sizes, shapes, materials and lip designs.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within 1.5 their scope.

For example, it is envisioned that the fork could be adjustable and contain an adjustment mechanism. For example, while a shorter fork requires less strength to throw, it requires the user to bend down to pick up the frisbee. As a result, a user may desire to increase a length of the fork so that the user does not have to bend over to pick up a frisbee with the device.

Additionally, although frisbees are generally discussed herein, other dick-like objects may be thrown by the devices contemplated herewith, such as but not limited to clay pigeons and other non-frisbee discs.

It is also envisioned that the fork, could be comprised of a material that has a lateral stiffness to help keep a disk securely in the device while throwing. Having a lateral stiffness also helps with achieving a more consistent release of a disk. However, it is envisioned that the fork, could also be comprised of a material that would allow the fork to flex, or bend, during operation, thereby creating secure fit of a disk with the device, as well as optimal throwing power.

The handle could also have a hole in it for hanging and storing the device. For instance, the device could be hung from a hook when not. Also, it is envisioned that the prong surfaces may not be flat, but curved.

As a non-limiting example, there may be a spring-loaded "grabber arm" similar to devices that are used to pick up trash (or other items) without bending down. The grabber arm would be spring loaded and would be set to release the frisbee at the point of the wrist snap with a given amount of force. The spring-loaded grabber arm could also have a manual release that the person would squeeze (or release) at the end of the throw to release the frisbee.

Another non-limiting example is that there may he magnets to connect the frisbee to the device. There may be small metal contacts inside the rim of the frisbee (for instance three or more points that are evenly spaced apart on the rim) and a magnet in the end of the throwing device would grab those points on the frisbee which would allow the user to pick up and throw the frisbee without ever touching it. The magnets would have a set amount of attraction to the metal points in the frisbee so they would release during the snap under the correct amount of force. The setup could also work in reverse with the magnets in the rim of the frisbee and the device having metal points in the ends of the prongs.

A still yet another non-limiting example is that there may be hook-and-loop coupling members (e.g. those sold under the brand Velcro) positioned and oriented to hold the frisbee to the throwing device. The coupling members would have enough force to pick up and grip the frisbee and would release the frisbee under the correct amount of necessary force during the wrist snap.

It is expected that there could be numerous variations of the design of this invention. An example is that the fork could be designed with a variety of lengths.

Even more, it is envisioned that the clip may have an indent in it that is shaped to grip the circular rim of a soft, canvas style frisbee. This keeps the frisbee in the device until the moment of release. However, the indent in the clip may be absent, especially in a version intended to throw hard frisbees and the like.

Finally, it is envisioned that the components of the device may be constructed of a 1.5 variety of materials, such as, but not limited to: plastic, rubber, metal, wood, fiberglass, composite materials and/or various textiles.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, st methods described herein.

What is claimed is:

1. A disk throwing device, comprising:

a) a handle;

b) a fork, coupled to the handle and extending therefrom along a first axis, the fork having a pair of prongs extending therefrom from an end thereof opposite the handle, the pair of prongs meeting at a prong junction and having a common top surface substantially orthogonal to the first axis such that a disk may slide freely across the top surface; and c) a clip, extending orthogonally away from the fork in relation to the first axis at a first portion at the prong junction and having a second portion coupled to the first portion that extends substantially parallel to the first axis such that it may trap a disk between the clip and the pair of prongs.

2. The disk throwing device of claim 1, further comprising a rigid webbing, coupled to the pair of prongs and disposed therebetween.

3. The disk throwing device of claim 1, further comprising an adjustment mechanism functionally coupled to the prongs, such that a distance between the pair of prongs is adjustable.

4. The disk throwing device of claim 1, wherein the prongs are tapered.

5. The disk throwing device of claim 1, wherein the pair of prongs together form a section of an ellipse.

6. The disk throwing device of claim 1, wherein one of the prongs includes an array of grooves.

7. The disk throwing device of claim 1, wherein each prong includes a flat bottom surface and a flat top surface and wherein the flat bottom surface is substantially parallel to the flat top surface.

8. The disk throwing device of claim 1, wherein one of the prongs includes a plurality of spiked grooves, coupled to an outside edge of a distal prong end, and extending outwardly therefrom.

9. The disk throwing device of claim 1, wherein the fork includes a weighted portion disposed along a length of the fork.

10. The disk throwing device of claim 1, wherein the handle includes: a first handle indent disposed along a top handle side; and a second handle indent, disposed along a bottom handle side, opposite the top handle side.

11. A disk throwing device, comprising:

a) a handle;

b) a fork, coupled to the handle and extending therefrom along a first axis, the fork having a pair of prongs extending therefrom from an end thereof opposite the handle, the pair of prongs meeting at a prong junction and having a common top surface substantially orthogonal to the first axis such that a disk may slide freely across the top surface;

c) a rigid webbing, coupled to the pair of prongs and disposed therebetween; and d) a clip, extending orthogonally away from the fork in relation to the first axis at a first portion at the prong junction and having a second portion coupled to the first portion that extends substantially parallel to the first axis such that it may trap a disk between the clip and the pair of prongs.

12. The disk throwing device of claim 11, further comprising an adjustment mechanism functionally coupled to the prongs, such that a distance between the pair of prongs is adjustable.

13. The disk throwing device of claim 12, wherein the prongs are tapered towards the front of each prong.

14. The disk throwing device of claim 13, wherein the pair of prongs together form a section of an ellipse.

15. The disk throwing device of claim 14, wherein each prong includes an array of ridges, disposed along a front edge of the distal prong end.

16. The disk throwing device of claim 15, wherein each prong includes a flat bottom surface and a flat top surface and wherein the flat bottom surface is parallel to the flat top surface.

17. The disk throwing device of claim 16, wherein each prong includes a plurality of spiked grooves, coupled to an outside edge of the distal prong end, and extending outwardly therefrom.

18. The disk throwing device of claim 17, wherein the fork includes a weighted portion disposed along a length of the fork.

19. The disk throwing device of claim 18, wherein the handle includes: a first handle indent disposed along a top handle side; and a second handle indent, disposed along a bottom handle side, opposite the top handle side.

20. A disk throwing device, comprising:

a) a handle;

b) a fork, coupled to the handle and extending therefrom along a first axis, the fork having a pair of curved prongs extending therefrom from an end thereof opposite the handle, the pair of prongs meeting at a prong junction and having a common top surface substantially orthogonal to the first axis such that a disk may slide freely across the top surface, wherein:

b1) the prongs are tapered such that: a diameter of a distal prong end is less than a diameter of a proximate prong end;

b2) the pair of prongs together form a section of an ellipse;

b3) each prong includes a flat bottom surface and a flat top surface and wherein the flat bottom surface is parallel to the flat top surface;

b4) each prong includes an array of ridges, disposed along a front edge of the distal prong end; and b5) each prong includes a plurality of spiked grooves, coupled to an outside edge of the distal prong end, and extending outwardly therefrom;

c) a rigid webbing, coupled to the pair of prongs and disposed therebetween;

d an adjustment mechanism functionally coupled to the prongs, such that a distance between the prongs is adjustable; and e) a clip extending orthogonally away from the fork in relation to the first axis at a first portion at the prong junction and having a second portion coupled to the first portion that extends substantially parallel to the first axis such that it may trap a disk between the clip and the pair of prongs.

* * * * *